US009657605B2

(12) United States Patent
Liu et al.

(10) Patent No.: US 9,657,605 B2
(45) Date of Patent: May 23, 2017

(54) STEAM POWER GENERATING SYSTEM AND METHOD THEREOF

(71) Applicant: TAIZHOU DAJIANG INDUSTRY CO., LTD., Taizhou, Zhejiang (CN)

(72) Inventors: Guiwen Liu, Taizhou (CN); Mingjun Yang, Taizhou (CN); Jinquan Huang, Taizhou (CN)

(73) Assignee: TAIZHOU DAJIANG INDUSTRY CO., LTD., Taizhou, Zhejiang (CN)

( * ) Notice: Subject to any disclaimer, the term of this patent is extended or adjusted under 35 U.S.C. 154(b) by 292 days.

(21) Appl. No.: 14/161,712

(22) Filed: Jan. 23, 2014

(65) Prior Publication Data

US 2015/0198067 A1 Jul. 16, 2015

(30) Foreign Application Priority Data

Jan. 10, 2014 (CN) ..... 2014 1 0013320

(51) Int. Cl.
*F22B 15/00* (2006.01)
*F22B 29/06* (2006.01)
(Continued)

(52) U.S. Cl.
CPC ..... *F01K 27/00* (2013.01); *F22B 1/288* (2013.01); *F22B 3/00* (2013.01); *F22B 3/08* (2013.01);
(Continued)

(58) Field of Classification Search
CPC ..... F22B 15/00; F22B 29/061; F22B 3/00; F22B 3/08; F22B 1/288; F01K 27/00; F24J 3/003
See application file for complete search history.

(56) References Cited

U.S. PATENT DOCUMENTS 4,352,252 A 10/1982 Brenot
5,279,262 A 1/1994 Muehleck
(Continued)

FOREIGN PATENT DOCUMENTS

CA 2223457 12/1996
CN 2397425 Y 9/2000
(Continued)

OTHER PUBLICATIONS

Canadian Intellectual Property Office, "1st Office Action for CA Application No. 2,840,902", Canada, Dec. 10, 2015.
(Continued)

*Primary Examiner* — Mark Laurenzi
*Assistant Examiner* — Wesley Harris
(74) *Attorney, Agent, or Firm* — Tim Tingkang Xia, Esq.; Locke Lord, LLP

(57) ABSTRACT

A steam power generating system is provided with an inflow pipe, a split-flow member disposed rearward of a screw-plug with the inflow pipe passing through, a blocking member disposed rearward of the split-flow member, a cylindrical case disposed rearward of the blocking member, a thermal conductor in the case, a base disposed rearward of the case, a porous member disposed rearward of the base, a hollow cylinder secured onto the screw-plug, the split-flow member, the blocking member, the cylindrical case, and the porous member, a heat source around the cylinder, an insulation member around the heat source, a steam output disposed rearward of the porous member, a power conversion device disposed rearward of the steam output for receiving steam therefrom, and a cooling device interconnecting the power conversion device and a pump.

1 Claim, 2 Drawing Sheets

(51) Int. Cl.

| | |
|---|---|
| ***F22B 3/00*** | (2006.01) |
| ***F22B 3/08*** | (2006.01) |
| ***F01K 27/00*** | (2006.01) |
| ***F24J 3/00*** | (2006.01) |
| ***F22B 1/28*** | (2006.01) |

(52) U.S. Cl.
CPC ..... *F22B 15/00* (2013.01); *F22B 29/061* (2013.01); *F24J 3/003* (2013.01)

(56) References Cited

U.S. PATENT DOCUMENTS

| | | | |
|---|---|---|---|
| 5,419,306 | A | 5/1995 | Huffman |
| 5,671,700 | A | 9/1997 | Lackstrom |
| 5,989,437 | A | 11/1999 | Eriksson et al. |
| 8,495,973 | B2 | 7/2013 | Poshusta et al. |
| 8,528,649 | B2 | 9/2013 | Kolle |
| 2003/0230567 | A1 | 12/2003 | Centanni et al. |
| 2004/0221583 | A1* | 11/2004 | Wylie ..... F01K 23/067 60/781 |
| 2011/0083619 | A1* | 4/2011 | Master ..... F22B 1/16 122/32 |
| 2013/0270352 | A1 | 10/2013 | Roth et al. |

FOREIGN PATENT DOCUMENTS

| | | | |
|---|---|---|---|
| CN | 201382398 | Y | 1/2010 |
| CN | 201629696 | U | 11/2010 |
| CN | 102803724 | A | 11/2012 |
| CN | 102865568 | A | 1/2013 |

OTHER PUBLICATIONS

International Search Report issued by the State Intellectual Property Office of the Peoples Republic of China (ISR/CN) for PCT/CN2014/071134 on Sep. 30, 2014.

* cited by examiner

STEAM POWER GENERATING SYSTEM AND METHOD THEREOF

BACKGROUND OF THE INVENTION

1. Field of the Invention

The invention relates to steam power and more particularly to a steam power generating system and method thereof.

2. Description of Related Art

For engine, the traditional gasoline engine and diesel engine not only generate harmful gas, but about 50% fuels are transformed into engine overheating heat during the process of burning. When this kind of engine rotates a crankshaft, its cost is very high and may cause abrasion and weight, etc. Therefore, the power-source device of transforming steam into mechanical power is installed in engine in order to manufacture piston-style steam engine and steam turbine engine. For piston-style steam engine, it is gradually eliminated because low efficiency of heat conversion and environment pollution; and the steam turbine engine is widely used in thermal power plants.

SUMMARY OF THE INVENTION

An object of the invention is to provide a steam power generating system comprising a screw-plug, an inflow pipe disposed through the screw-plug, a pump for transferring water to the inflow pipe, a split-flow member disposed rearward of both the screw-plug and the inflow pipe, a blocking member disposed rearward of the split-flow member, a cylindrical case disposed rearward of the blocking member, a thermal conductor disposed in the cylindrical case, a base disposed rearward of the cylindrical case, a porous member disposed rearward of the base, a hollow cylinder secured onto the screw-plug, the split-flow member, the blocking member, the cylindrical case, and the porous member, a heat source disposed around the hollow cylinder for heating water to generate steam, an insulation member disposed around the heat source and a portion of the screw-plug, a steam output disposed rearward of both the porous member and the hollow cylinder, a power conversion device disposed rearward of the steam output for receiving steam from the steam output, and a cooling device interconnecting the power conversion device and the pump and being in fluid communication with both the power conversion device and the pump.

The above and other objects, features and advantages of the invention will become apparent from the following detailed description taken with the accompanying drawings.

DETAILED DESCRIPTION OF THE INVENTION

Figure 1:
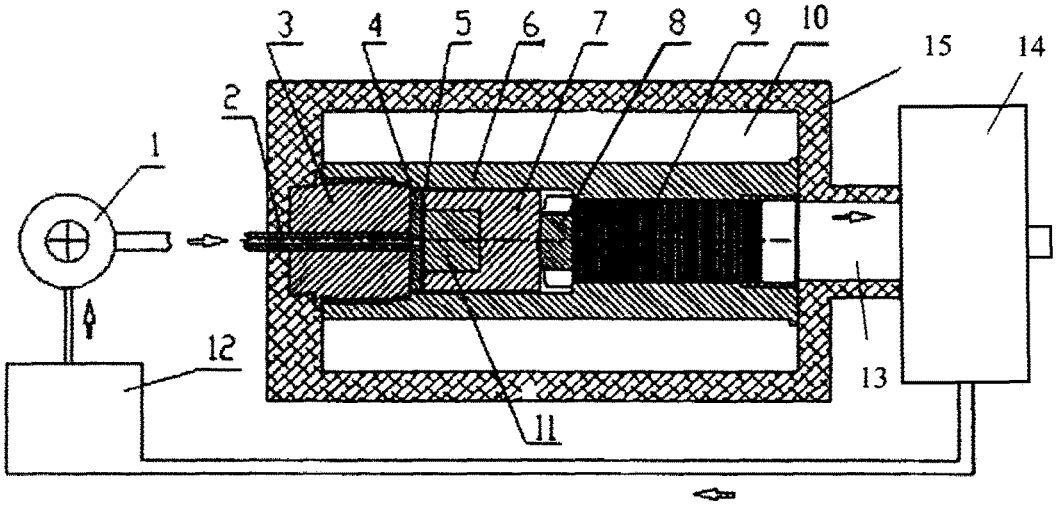
FIG. 1 is a schematic side view in part section of a steam power generating system of the invention.

Referring to FIGS. 1 to 5, a steam power generating system of the invention comprises an inflow pipe 2, a screw-plug 3, a split-flow member 4, a blocking member 5, a hollow cylinder 6, a cylindrical case 7, a base 8, a heat source 10 and a thermal conductor 11.

The inflow pipe 2 is embedded into the screw-plug 3, and the screw-plug 3 is connected with the hollow cylinder 6 by the screw thread, preload is applied to the split-flow member 4 and the blocking member 5, and the other side of the blocking member 5 is connected with the cylindrical case 7 and the thermal conductor 11.

The thermal conductor 11 is embedded inside the cylindrical case 7, and also can be secured to the cylindrical case 7. The other side of the cylindrical case 7 is connected with the base 8, and the base 8 is connected with a shoulder on the inner wall of the hollow cylinder 6. The outside of the cylinder 6 is provided with the heat source 10.

Figure 2:
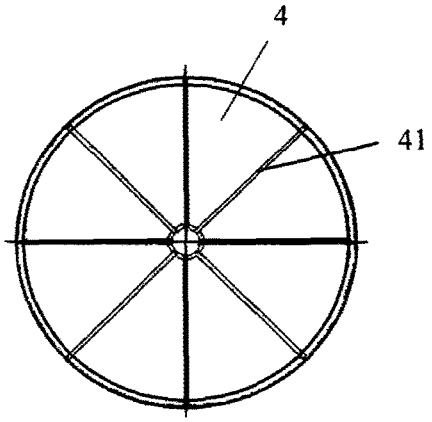
FIG. 2 is a front view of the split-flow member of the steam power generating system of the invention.
Figure 3:
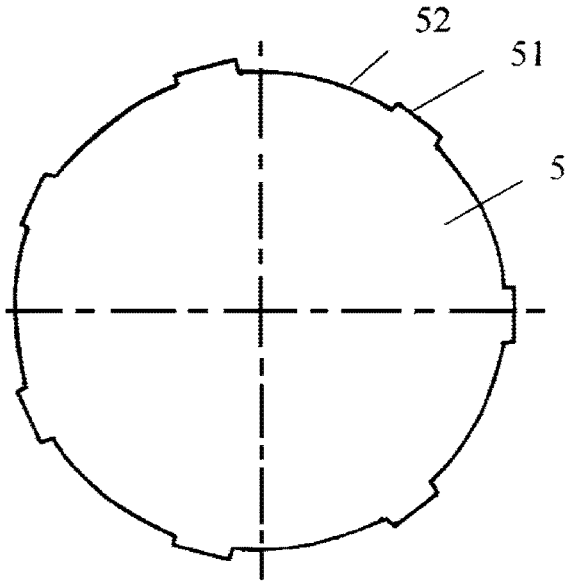
FIG. 3 is a front view of the blocking member of the steam power generating system of the invention.

As shown in FIG. 2, the split-flow member 4 is provided with several grooves 41, such that the high-pressure liquid can enter into the grooves 41 through the inflow pipe 2. As shown in FIGS. 1 and 3, the blocking member 5 contacts the split-flow member 4 (FIG. 1), and has several projections 51 and troughs 52 on its periphery (FIG. 3).

The edge of the projection 51 supports the inner surface of the hollow cylinder 6, and the liquid in the groove 41 of the split-flow member 4 can flow into a tiny channel through the trough 52 of the blocking member 5. The tiny channel is defined between the outer surface of the cylindrical case 7 and the inner surface of the hollow cylinder 6, and inside the tiny channel, the high-pressure water is heated to generate high-temperature saturated water.

The tiny channel includes a gap 71 between the outer surface of the cylindrical case 7 and the inner surface of the hollow cylinder 6, and a width of the gap 71 is less than 1 mm.

Alternatively, the tiny channel includes several grooves 72 defined on the outer surface of the cylindrical case 7, and a width of each groove 72 is less than 1 mm and a depth of it is less than 1 mm.

In operation, the high-pressure liquid (water) enters into the inflow pipe 2 through a pump 1, and is split into the groove 41 of the split-flow member 4. The split water in the groove 41 of the split-flow member 4 is blocked by the blocking member 5, and then enters into the tiny channel through the trough 52 of the blocking member 5. The water entered into the tiny channel is heated in a narrow space of the tiny channel to form high-temperature and high-pressure saturated water. Thereafter the high-temperature and high-pressure saturated water is sprayed out from the tiny channel and then forms tiny saturated water particles and in turn forms high-temperature and high-pressure steam.

A porous member 9 is placed inside the hollow cylinder 6 and placed on the end close to a steam output 13. The porous member 9 may be a mesh structure. The steam output 13 is connected with a power conversion device 14 which can be steam turbine.

The outside of the hollow cylinder 6 is the heat source 10, and heat of the heat source 10 can be generated by burning fuels or can be waste heat. The outside of the heat source 10 can be covered by an insulation member 15. The screw-plug 3 is connected with the hollow cylinder 6 by screw thread, and in the meantime generates preload pressure to the split-flow member 4 and the blocking member 5, and it is locked tightly and sealed between the end surface of the screw-plug 3 and the hollow cylinder 6.

Figure 4:
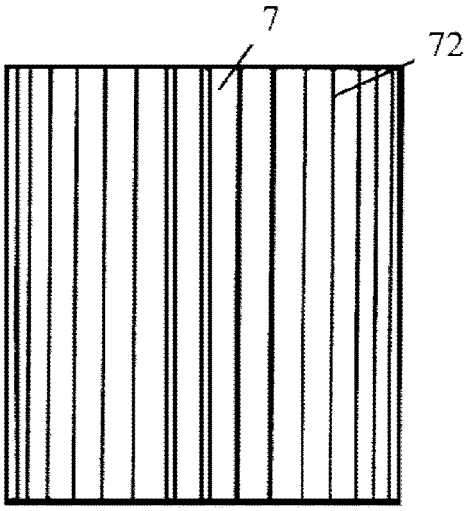
FIG. 4 is a side view of the case of the steam power generating system of the invention.
Figure 5:
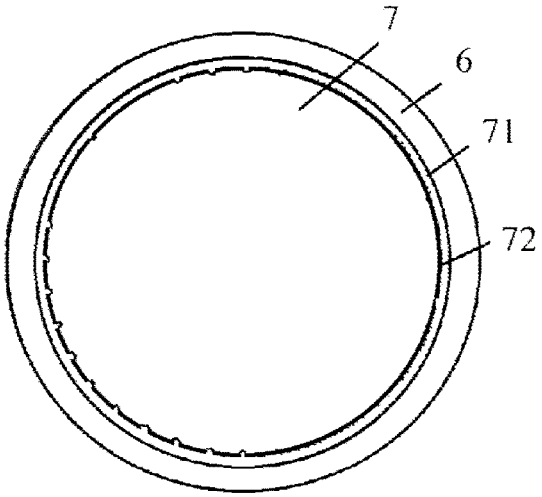
FIG. 5 is a front view of the cylinder and the case of the steam power generating system of the invention.

The cylindrical case 7 and the thermal conductor 11 are adjacent to the blocking member 5, and the cylindrical case 7 is solid or made of porous sintered material which is a high-temperature resistant, corrosion resistant and heat resistant steel material. The outer surface of the cylindrical case 7 is provided with a plurality of grooves 72 as shown in FIG. 4.

The thermal conductor 11 can be embedded into the cylindrical case 7 and is made of material with excellent high-temperature resistant and corrosion resistant characteristics. Since the ends of the blocking member 5 and the cylindrical case 7 contact the high-pressure liquid first, the heat is absorbed quickly by the high-pressure liquid, leading to drop of its own temperature. The base 8 and the hollow cylinder 6 function as support, and the porous member 9 is made of a heat resistant material.

A cooling device 12 is provided at the entrance of the high-pressure liquid, and the cooling device 12 is connected with the power conversion device 14.

Although the invention has been described in detail, it is to be understood that this is done by way of illustration only and is not to be taken by way of limitation. The scope of the invention is to be limited only by the appended claims.

What is claimed is:

1. A steam power generating system, comprising:

a screw-plug;

an inflow pipe disposed through the screw-plug;

a pump for transferring water to the inflow pipe;

a split-flow member disposed rearward of both the screw-plug and the inflow pipe, wherein the split-flow member is provided with several grooves in fluid communication with the inflow pipe;

a blocking member disposed rearward of the split-flow member, wherein the blocking member has several projections and troughs formed on its periphery, and the troughs are in fluid communication with the grooves of the split-flow member;

a cylindrical case disposed rearward of the blocking member;

a thermal conductor disposed in the cylindrical case, wherein the thermal conductor is made of a material with high-temperature resistant and corrosion resistant characteristics;

a base disposed rearward of the cylindrical case;

a porous member disposed rearward of the base;

a hollow cylinder secured onto the screw-plug, the split-flow member, the blocking member, the cylindrical case, and the porous member such that the projections of the blocking member is in contact with an inner surface of the hollow cylinder, a channel is defined between the inner surface of the hollow cylinder and an outer surface of the cylindrical case, and the channel is in fluid communication with the troughs of the blocking member;

a heat source disposed around the hollow cylinder for heating the water to generate steam;

a thermal insulation member disposed around the heat source and a portion of the screw-plug;

a steam output disposed rearward of both the porous member and the hollow cylinder; and a power conversion device disposed rearward of the steam output for receiving steam from the steam output;

wherein in operation, the pump transfers high-pressure water into the inflow pipe, the high-pressure water flows out from the inflow pipe and is then split by the split-flow member to enter into the grooves of the split-flow member, the high-pressure water in the grooves of the split-flow member flows into the channel between the hollow cylinder and the cylindrical case through the troughs of the blocking member, and is heated by the heat source to generate high-temperature and high-pressure saturated water, the high-temperature and high-pressure saturated water is output from the channel to form high-temperature and high-pressure steam that passes through the porous member and is output from the steam output to the power conversion device.

* * * * *